United States Patent [19]

Neary

[11] Patent Number: 4,471,582

[45] Date of Patent: Sep. 18, 1984

[54] SANDING DRUM

[76] Inventor: John R. Neary, P.O. Box 543, Kentville, Nova Scotia, Canada, B4N 1S4

[21] Appl. No.: 390,742

[22] Filed: Jun. 21, 1982

[30] Foreign Application Priority Data

Jul. 17, 1981 [CA] Canada ..... 381952

[51] Int. Cl.[3] ..... B24B 45/00

[52] U.S. Cl. ..... 51/366; 51/370

[58] Field of Search ..... 51/359, 364–371; 15/230, 230.17, 230.19, 231, 232, 188, 187, 230.11, 230.16

[56] References Cited

U.S. PATENT DOCUMENTS

| | | | |
|---|---|---|---|
| Re. 8,555 | 1/1879 | Dunham . | |
| 141,523 | 8/1873 | Thompson . | |
| 999,436 | 8/1911 | Dobyne . | |
| 2,472,899 | 6/1949 | Hein | 51/358 |
| 2,652,666 | 9/1953 | Longbotham . | |
| 2,789,401 | 4/1957 | Hargreaves . | |
| 3,116,576 | 1/1964 | Block . | |
| 3,774,354 | 11/1973 | Taylor . | |
| 3,975,868 | 8/1976 | Botimer | 51/370 |

FOREIGN PATENT DOCUMENTS

| | | |
|---|---|---|
| 96091 | 11/1905 | Canada . |
| 110981 | 3/1908 | Canada . |
| 328963 | 1/1933 | Canada . |
| 332976 | 6/1933 | Canada . |
| 458895 | 8/1949 | Canada . |
| 464989 | 5/1950 | Canada . |

OTHER PUBLICATIONS

Cone-Loc Drum Sanders Published by American Diamond Saw Company, 2 pages.

*Primary Examiner*—Frederick R. Schmidt
*Assistant Examiner*—Matthew D. Daschel
*Attorney, Agent, or Firm*—Moss, Hammond

[57] ABSTRACT

A sanding device for use with a drill press having a drum divided diametrically into half sections. The drum is covered by a unitary layer of resilient rubber-like material such as neoprene. The cover hinges the drum halves together along one side of the drum. When an abrasive sheet has been installed on the device, the two halves are joined together by a nut threaded onto a short shaft which projects from each end of the drum. The upper nut has a metal shaft extending coaxially from the nut and this shaft can be used to attach the device to a drill press chuck or directly to a shaft. The mechanism for attaching the abrasive sheet includes two slots each of which extends from the diametrical surface of a respective half section. Each slot extends the length of the drum and is adapted to accommodate one end of the abrasive sheet. Preferably each slot extends radially outwardly from the center axis of the drum and is disposed at an angle less than 45 degrees with respect to a drum radius extending along the diametrical surface of the respective drum half away from the hinge formed by the cover.

14 Claims, 6 Drawing Figures

SANDING DRUM

BACKGROUND OF THE INVENTION

This invention relates to sanding devices and in particular drum sanders suitable for sanding wood, plastics or metals.

A number of drum sanders are known in the sanding art and these sanders are most commonly used for sanding the contours of oddly shaped wood items. One type of drum sanders uses rubber wafers and it requires that special sanding sleeves be used. Because of the special nature of these sleeves, they tend to be expensive and hard to replace. The external diameter of the rubber wafers can be expanded to secure the sanding sleeve by tightening a bottom nut mounted on a threaded shaft. The wafers are also mounted in series on the threaded shaft and are squeezed between a washer mounted next to the bottom nut and a wide end portion of the shaft.

Another type of sanding drum is made by Singley Speciality Company of Hendersonville, N.C. and it employs a solid one-piece drum covered by a rubber-like layer. A hole extends from one end of the drum to the other and it is spaced a short distance from one side of the drum. A slot extends between this hole and the outer surface of the drum. An ordinary sheet of sandpaper can be mounted to this type of sander by bending the ends of the sheet to fit through the lengthwise slot. An oval aluminium tube is placed in the round hole and is then turned approximately 90 degrees with a special key in order to secure the sheet of sandpaper in place. There are several problems with this type of sanding drum including the fact that it is very difficult to secure the sandpaper properly. The oval tube often rips the sandpaper as it is being inserted into the hole and the tube can easily be bent out of shape since it is made of soft aluminium. Sometimes the tube can be hard to remove from the hole. In addition, it is difficult to tighten the sandpaper snuggly around the drum with this sanding device. If thick sandpaper is required, it can be even more difficult to attach to the drum.

An early type of sanding drum (also called a buffing mandrel) is shown in U.S. Pat. No. 141,523 dated Aug. 5, 1873 and issued to N. S. Thompson. This sanding device consisted of a drum divided diametrically into two half sections. The semi-cylindrical blocks forming the drum are attached together at one side by a hinge mechanism. At the axial centre of each semi-cylindrical block is half of a shaft which is threaded where the shaft projects from the blocks. The two halves of the shaft are connected together by means of two nuts with one nut being located at each end of the drum. In order to attach a sheet of sandpaper to the drum, the two halves are separated and the two ends of the sheet of sandpaper are fastened in place by means of pins which project from the diametrical surfaces of the two halves.

A newer drum sander having some similarities to the sander taught by the Thompson patent is that shown in U.S. Pat. No. 2,652,666 to T. Longbotham dated Sept. 22, 1953. This known sander has a split drum and the two halves are connected together at one side by means of a hinge. The two halves are covered with a thick band of synthetic rubber which is vulcanized upon the cylindrical outer surfaces. When a new sheet of sandpaper has been put in place, the two halves are brought together and are fastened at the centre by means of a conical collar. Spikes are embedded in each half of the drum sander and are located on the diametrical surface opposite the hinge side. These spikes are used to fasten in place the ends of the sheet of sandpaper. Some of the problems with these known drum sanders include the cost of making these sanders and the fact that they are not suitable for a sander having a diameter of less than one inch. It is believed that it would be difficult to manufacture a sander of the type taught by Longbotham if the diameter of the sander is to be three-quarters inch because the central shaft would have to be very small and it would not have the necessary strength. Furthermore, if a fairly long drum sander is required, a conical locking collar might be necessary at each end of the drum and a single collar would not suffice.

A deficiency in known sanding drums such as those taught by Thompson and Longbotham is that there is no mechanism provided for ensuring that the sheet of sandpaper will always be properly aligned on and arranged on the drum. With the known sanders it is easy to install the sandpaper improperly on the drum, particularly if the sheet of sandpaper has not been cut exactly in the correct manner. If the sandpaper is installed so that it projects beyond one end of the drum, it will not tighten equally around the full outer surface of the drum.

Another possible problem with known drum sanders occurs when thin sandpapers are being used. With such papers, the retention ability of the pins embedded in the diametrical surfaces of the two halves may not be sufficient. In fact thin sandpapers can tear at the location where they are pierced by the pins under heavy usage. With thicker sandpapers, there is less of a problem because these papers are sandwiched between the drum halves and the clamping force exerted by the drum halves helps the pins to retain the ends of the sandpaper.

It is an object of the invention to provide a sanding device with improved means for attaching an abrasive sheet.

It is a further object to provide sheet attachment means that makes it easier to properly align the sheet on a sanding drum.

The invention is directed to a sanding drum provided with two slots each of which is formed in a half section of the drum and extends from the diametrical surface thereof. These slots assist in the proper alignment of the sanding sheet on the drum and they can also help to hold the ends of the sheet of sandpaper in place.

SUMMARY OF THE INVENTION

Accordingly, the sanding device of the invention comprises a drum divided diametrically into half sections, a threaded shaft located at each end of the drum, and means for detachably joining the halves together. The device has means for attaching one end of the drum to a rotary drive mechanism and means for detachably joining an abrasive sheet to the device in such a manner that the sheet is wrapped around the cylindrical surface of the drum. The connecting means include two slots each formed in a respective half section and extending from the diametrical surface thereof. Each slot extends the length of the drum and is adapted to accommodate one end of the abrasive sheet. Each slot is at least partially closed at each end of the drum by the shaft whereby proper alignment of an abrasive sheet on said device is obtained by use of the slots.

Preferably a cover for the drum is provided and this cover consists of a layer of resilient, rubber-like material secured to the cylindrical periphery of the drum. This cover hinges the drum halves together at one side of the drum. In the preferred embodiment, each slot extends radially outwardly from the centre axis of the drum and is disposed at an angle less than 45 degrees with respect to a drum radius extending along the diametrical surface of the respective drum half away from the hinge formed by the cover. A preferred embodiment of a sanding drum constructed in accordance with the present invention will now be described with reference to the accompanying drawings.

DETAILED DESCRIPTION OF PREFERRED EMBODIMENT

Figure 1:
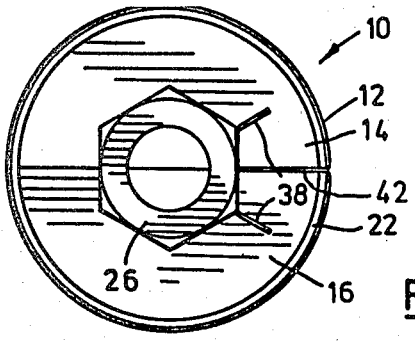
FIG. 1 is a view of the bottom end of a sanding drum constructed in accordance with the invention.

The sanding device 10 of the invention includes a drum 12 divided diametrically into half sections 14 and 16. The body of the drum can be made from a plastics material that is strong and durable. A suitable plastics material is polycarbonate. A short threaded shaft 18, 20 extends from each end of the drum and the shafts are coaxial with the main section of the drum. As can be seen from FIG. 3, the shafts 18 and 20 are also divided diametrically into half sections. The shafts can be made integral with the remaining part of the drum and thus they also are made from a plastics material. The drum can be made in a variety of widths including widths that are less than one inch.

Extending about the cylindrical surface of the drum is a cover 22 made of a layer of resilient, rubber-like material which is firmly secured to the periphery of the drum. As can be seen from FIG. 3, the cover acts as a hinge pivotally connecting the drum halves together. The preferred material for this layer is neoprene which can be bonded securely to the plastic drum. A vulcanizing step can be used to secure the layer or if necessary a suitable adhesive. The flexible rubber backing serves as a cushion for the sand paper 24 placed on top of this layer. The sandpaper will wear longer with a resilient layer underneath it. It will be appreciated that the rubber layer need not be used as a hinge for the two half sections. Instead, a suitable metal hinge and a hinge pin or pins could be employed. If a mechanical hinge of this nature is used, it should not project beyond the cylindrical perimeter of the sanding drum.

Figure 5:
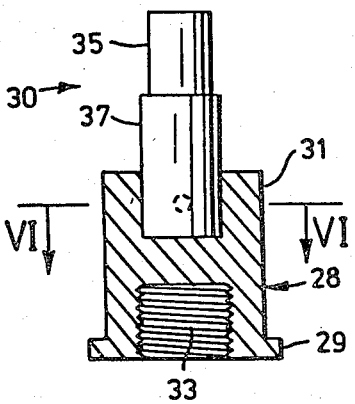
FIG. 5 is a diametrical cross-section showing the top nut member with a shaft for connecting the sanding device to a drill press chuck or directly to a shaft.
Figure 6:
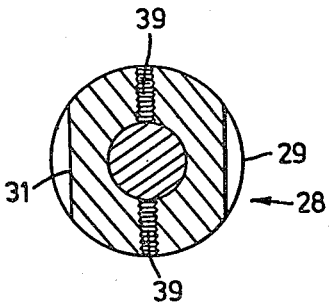
FIG. 6 is a cross-section taken along the line VI—VI of FIG. 5.

Two nuts are provided for detachably joining the half sections of the drum together, thereby preventing relative movement between the two half sections. The bottom nut 26 is a standard nut adapted to thread onto the shaft 20. Thus the nut 26 is relatively inexpensive and can be readily replaced if necessary. The construction of the top nut 28 can best be seen from examination of FIGS. 5 and 6. The nut is elongated and, as shown, has a length that is almost equal to its diameter. The nut is formed with a circular base at 29. The larger, upper portion of the nut has two flat sides 31. In one preferred embodiment of the nut 28, the length of the flat sides is 1 ⅛ inches. The nut is of course threaded internally at 33 so that the nut can be threaded onto the shaft 18.

Mounted at one end of the nut 28 is a step shaft 30. In one preferred embodiment, the diameter of the narrow section 35 of the shaft is ⅜ inch while the diameter of the wide section 37 is ½ inch. With the use of such a step shaft, the sanding drum can be easily attached to either a ⅜ inch or a ½ inch drill chuck. Alternatively the step shaft can be removed from the nut 28 entirely by loosening the allen set screws 39 located in diametrical holes formed in the nut 28. When the step shaft is removed, the top nut 28 can be attached directly to a ½ inch electric motor shaft or some other ½ inch driven shaft. Moreover, if desired, the top nut 28 can easily be drilled from ½ inch to ⅝ inch by the purchaser to enable the top nut 28 to be attached directly to a ⅝ inch electric motor shaft.

The sanding device of the invention includes means for attaching an abrasive sheet to the device so that the sheet extends around the cylindrical surface of the drum 12. The attaching means include studs or pins 32 that project from the diametrical surface of each half section of the drum. In the illustrated embodiment there are three pins located a short distance from the semi-cylindrical outer surface of each half section. These pins are made of metal such as steel or brass. Small holes 34 are formed in each diametrical surface to accommodate the metal studs 32 projecting from the opposite half section. Because the studs are accommodated in these holes 34, the half sections can be brought together to the position shown in FIG. 1.

Figure 2:
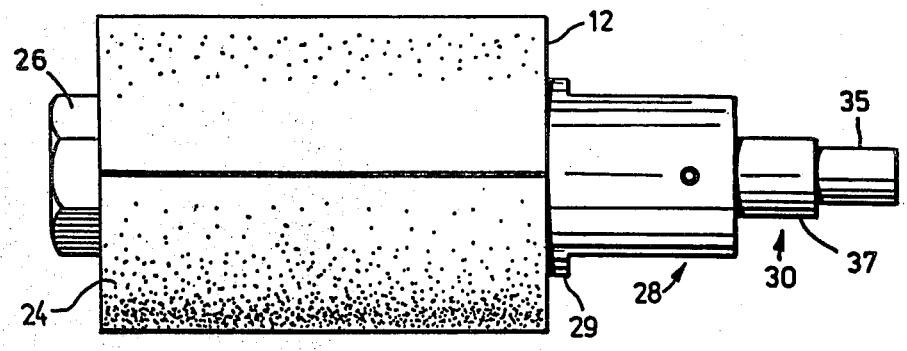
FIG. 2 is a side view of the sanding drum with a sheet of sandpaper covering the cylindrical surface thereof.
Figure 3:
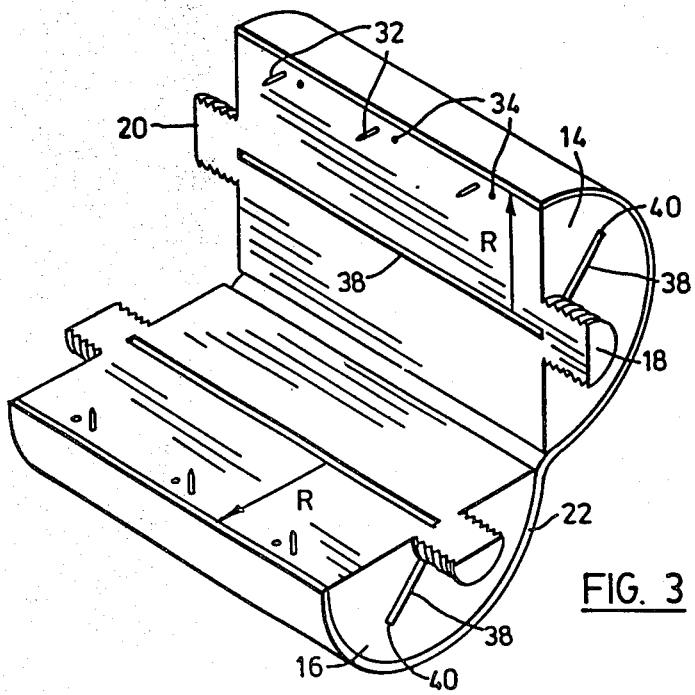
FIG. 3 is a perspective view of the sanding drum of FIG. 2 with the connecting nuts at each end removed and the two half sections separated.
Figure 4:
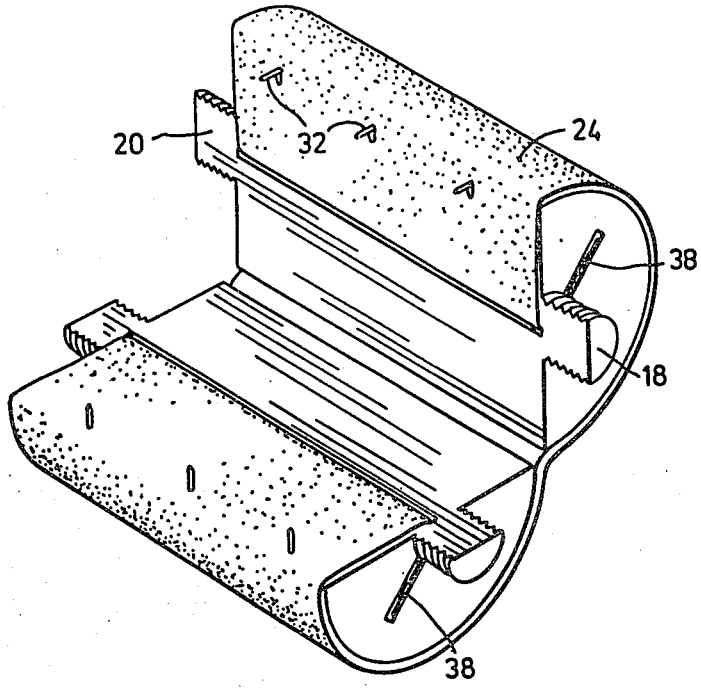
FIG. 4 is a perspective view similar to FIG. 3 but showing a sheet of sandpaper installed on the two half sections.

The sanding device includes two slots 38 which are part of the means for attaching the abrasive sheet 24 to the device in the manner shown in FIG. 2, that is, the sheet extends around the cylindrical surface of the drum. A slot 38 is found in each half section and each slot extends from the diametrical surface of the half section. As shown in FIG. 3, each slot extends the length of the drum. Preferably the slots extend radially outwardly from the centre axis of the drum as shown. When the slots are arranged in this manner, the slots are at least partially closed at each end of the drum by respective portions of the shafts 18 and 20. In this way, when one end of a sheet of sandpaper is inserted into a slot 38, proper alignment of the sheet on the sanding device can be assured. Assuming that the sheet is cut squarely and has the correct dimensions, it is simply necessary to ensure that the end of the sheet abuts against the bottom of the slot at 40. The sheet cannot project beyond either end of the drum due to the presence of the parts of shafts 18 and 20 located at opposite ends of the half section.

In order that the slots 38 will assist the pins 32 to hold the ends of the abrasive sheet firmly between the half sections, the slots are disposed at an angle equal to or less than 90 degrees with respect to a drum radius R extending along the diametrical surface of the respective drum half away from the hinge formed by the cover 22. Preferably the slot is disposed at an angle less then 45 degrees with respect to the drum radius R. Most preferably the slot extends at an angle of 20 degrees or less with respect to the drum radius R. It will be appreciated that the smaller the angle between each slot and the radius R, the greater the amount the sheet of sandpaper is bent backwards and the sharper the edge formed at the point where the slot meets the diametrical surface of the half section. When the angle is quite small, the ends of the sheet of abrasive will be held rather firmly between the half sections. If the slots were not provided, the ends of the sandpaper could become loosened and partly or wholly pulled from between the half sections. Thin sandpaper will sometimes tear where the sheet is pierced by the pins 32, particularly under heavy usage. This is partly due to the fact that the space between the two half sections of the drum in the region indicated at 42 in FIG. 1 must accommodate a thicker, coarse sandpaper as well as thin sandpaper. Therefore, although the half sections do adequately clamp the thicker, coarse type sandpapers between their diametrical surfaces, any such clamping effect is considerably less or non existent when thin sandpapers are being used.

It has been found that the combination of the pins 32 and the two slots 38 provides quite adequate means for holding even thin sandpapers on the sanding drum. Moreover, the addition of the slots 38 does not complicate the manufacturing process to any significant extent. Each slot can be created by a simple change in the mould which forms each half of the drum.

It will be appreciated that various modifications can be made to the sanding drum described herein without departing from the spirit and scope of this invention. For example, the drum itself could be made from a variety of materials including plastics and metals and need not necessarily be made from plastic. Also it is conceivable that the shafts 18 and 20 could be made as separate parts which are later attached to half sections forming the drum.

What I claim as my invention is:

1. A sanding device comprising a drum divided diametrically into half sections, a threaded shaft located at each end of said drum and coaxial therewith, each shaft also being divided diametrically into halves, a cover for said drum made of a layer of rubber-like material secured to the cylindrical periphery of said drum, said cover hinging said drum sections together, nuts threadable onto the two shafts for joining said drum sections together and thereby preventing relative movement between the two half sections, means for connecting said device to a rotary drive mechanism, means for attaching an abrasive sheet to said device so that said sheet extends around the cylindical surface of said drum said attaching means including two slots each of which extends from the diametrical surface of a respective half section wherein each slot extends the length of said drum, is adapted to accomodate one end of said sheet, and is at least partially closed at each end of the drum by said shafts whereby proper alignment of an abrasive sheet on said device is obtained by use of said slots.

2. A sanding device according to claim 1 wherein each slot extends radially outwardly from the centre axis of the drum.

3. A sanding device according to claim 1 wherein each slot is disposed at an angle equal to or less than 90 degrees with respect to a drum radius extending along the diametrical surface of the respective drum half away from the hinge formed by said cover.

4. A sanding device according to claim 3 wherein each slot is disposed at an angle less than 45 degrees with respect to said drum radius.

5. A sanding device according to claim 3 wherein said connecting means comprises an unthreaded shaft detachably connected to one of said nuts and coaxial with said one nut.

6. A sanding device according to claim 1 wherein said said drum is made of a rigid plastics material.

7. A sanding device according to claim 1 wherein said cover is made of neoprene.

8. A sanding device according to claim 1 wherein said attaching means also includes metal studs partly embedded in the diametrical surface of each half section of said drum, said studs being located a short distance from the semi-cylindrical outer surface of each half section.

9. A sanding device according to claim 1 wherein each slot is disposed at an actue angle with respect to a drum radius extending along the diametrical surface of the respective drum half away from the hinge formed by said cover.

10. A sanding device according to claim 3 wherein each threaded half shaft is integral with the remaining part of a respective drum half section.

11. A sanding device according to claim 5 wherein said unthreaded shaft is made of steel and is fastened by screws in one end of said one nut.

12. A sanding device comprising a drum divided into half sections, a threaded shaft located at each end of said drum and coaxial therewith, each shaft also being divided diametrically into halves, means for detachably joining said half sections together, means for attaching one end of said drum to a rotary drive mechanism, means for detachably connecting an abrasive sheet to said device in such a manner that the sheet is wrapped around the cylindrical surface of said drum, said connecting means include two slots each formed in a respective half section and extending from the diametrical surface thereof, wherein each slot extends the length of said drum, is adapted to accommodate one end of said sheet, extends radially outwardly from the centre axis of the drum, and is at least partially closed at each end of drum by said shafts whereby proper alignment of an abrasive sheet on said device is obtained by use of said slots.

13. A sanding device according to claim 12 wherein said attaching means includes a step shaft detachably connected to said joining means.

14. A sanding device according to claim 13 wherein said joining means includes two nuts and said step shaft is connected to one end of one of said nuts.

* * * * *